United States Patent [19]

Kelly

[11] Patent Number: 4,825,540

[45] Date of Patent: May 2, 1989

[54] FABRICATION OF MODULAR ELECTRICAL WIRING TRACKS

[76] Inventor: Steven M. Kelly, 461 Baker St., Cromwell, Ind. 46732

[21] Appl. No.: 86,026

[22] Filed: Aug. 17, 1987

Related U.S. Application Data

[62] Division of Ser. No. 808,287, Dec. 12, 1985, Pat. No. 4,688,869.

[51] Int. Cl.[4] ..... H01R 13/60; H01R 13/627

[52] U.S. Cl. ..... 29/861; 29/857; 29/868; 439/209

[58] Field of Search ..... 29/857, 861, 868; 439/121, 152, 209, 350, 502

[56] References Cited

U.S. PATENT DOCUMENTS

| | | | |
|---|---|---|---|
| 2,192,899 | 3/1940 | Edmonson | 439/120 X |
| 2,234,745 | 3/1941 | Rarrel | 439/120 X |
| 2,250,513 | 7/1941 | Von Gehr | 439/120 |
| 2,979,686 | 4/1961 | Longmire | 439/115 |
| 3,308,416 | 3/1967 | Boyd | 439/120 X |
| 4,108,523 | 8/1978 | Bolis | 439/116 |
| 4,135,775 | 1/1979 | Driscoll | 439/215 |
| 4,688,869 | 8/1987 | Kelly | 439/209 |

*Primary Examiner*—Howard N. Goldberg
*Assistant Examiner*—Taylor J. Ross
*Attorney, Agent, or Firm*—Roger M. Rickert

[57] ABSTRACT

A method for fabricating an electrical energy distribution system as a track having a multitude of parallel insulating strips and interspersed conductor bars with gaps between adjacent conductor bars to receive conductive blades of outlets or jumper cables for receiving power from the system as well as fixedly supporting a set of blades for power input to the system. During fabrication, the elongated insulating strips and conductor bars are passed through at least two spaced apart transverse multi-apertured separators so that the conductor bars define therebetween blade receiving gaps. As thus fabricated, the system is modular and may be assembled without the need of tools or specially trained electricians.

10 Claims, 3 Drawing Sheets

FABRICATION OF MODULAR ELECTRICAL WIRING TRACKS

This is a divisional application of application Ser. No. 808,287, filed Dec. 12, 1985, now U.S. Pat. No. 4,688,869 granted Aug. 25, 1987.

SUMMARY OF THE INVENTION

The present invention relates generally to power distribution systems and more particularly to such systems which may be configured by the user without the need for a professional electrician nor special tools during a particular installation or rearrangement of the system.

By way of background, prefabricated office partitions with power and/or communication raceways running along the top or bottom edges have been known for several years. Illustrative of such systems are U.S. Pat. Nos. 4,056,297; 4,060,294; and 4,135,775. In such systems, power outlets or receptacles are positioned in discrete predetermined fixed locations and jumper cables which interconnect two such sections or partitions must connect to the respective raceways at fixed locations. Thus, in assembling or rearranging such office partitions wherein jumper cables are employed, numerous jumper cables of different lengths may be needed. Such jumper cables are avoided in the aforementioned U.S. Pat. No. 4,060,294 by forming the electrical coupling between panels as a part of the mechanical coupling between those panels and in some cases as a hinged mechanical coupling between those panels. Such an arrangement while avoiding the need for various cable lengths requires the power distribution system to be built in as an integral part of the panel system and further increases the overall cost of the power distribution system.

Prewired prefabricated office partitions generally suffer from one or more of the following defects. Discrete outlet and jumper cable locations on the partitions generally result in jumper cable between panels being too long, or worse yet, too short. This problem is compounded at corners between multiple panels and typically results in limited versatility of the system generally. Connection of the distribution system to a power source by alternate paths and alternate fusing may sometimes occur in these known systems thereby effectively dangerously doubling the current capacity before fuse protection prevails.

Among the several objects of the present invention may be noted the provision of an electrical energy distribution system which obviates the foregoing prior art limitations; the provision of an electrical energy distribution system having at least two independently fused circuits which are relatively shielded and otherwise isolated to provide substantially transient free power, for example, for microelectronic circuit employing devices; the provision of a track power distribution system with access throughout any one of several continuous regions of a track; and the provision of a technique for fabricating power distribution channels to ensure that any system built up from such channels receives its power from but a single source without any alternate circuit paths back to the source. These as well as numerous other objects and advantageous features of the present invention will be in part apparent and in part pointed out hereinafter.

In general, an electrical energy distribution system includes a plurality of elongated generally parallel insulating strips with a spaced pair of elongated parallel conductive bars between each adjacent pair of insulating strips defining therebetween a circuit path gap. Power supplying conductive blades enter the circuit path gaps contacting both conductors Also in general, and in one form of the invention, an electrical energy distribution system having a plurality of elongated relatively rigid power distribution channels interconnected by a plurality of flexible multiconductor cables with each channel having a single set of protruding blades for receiving energy and in turn being adapted to receive the protruding blades of power outlet receptacles or connector blocks at one end of a multiconductor cable for supplying power to a further power distribution channel is disclosed.

Still further in general and in one form of the invention, a relatively rigid power distribution channel is fabricated by providing a number of elongated insulators with elongated conductor bars along lateral surfaces of the insulators and with the insulators and their corresponding conductor bars in turn passing through at least two spaced apart transverse multi-apertured separators to maintain the insulators and conductors in generally coplanar alignment. A single set of commonly supported connector blades pass transversely through gaps between the conductor bars and extend in a cantilevered manner for subsequent connection to a source of electrical energy. The commonly supported conductor blades, separators and conductor bars are then captured between a pair of elongated outer rails.

BRIEF DESCRIPTION OF THE DRAWINGS

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 1:
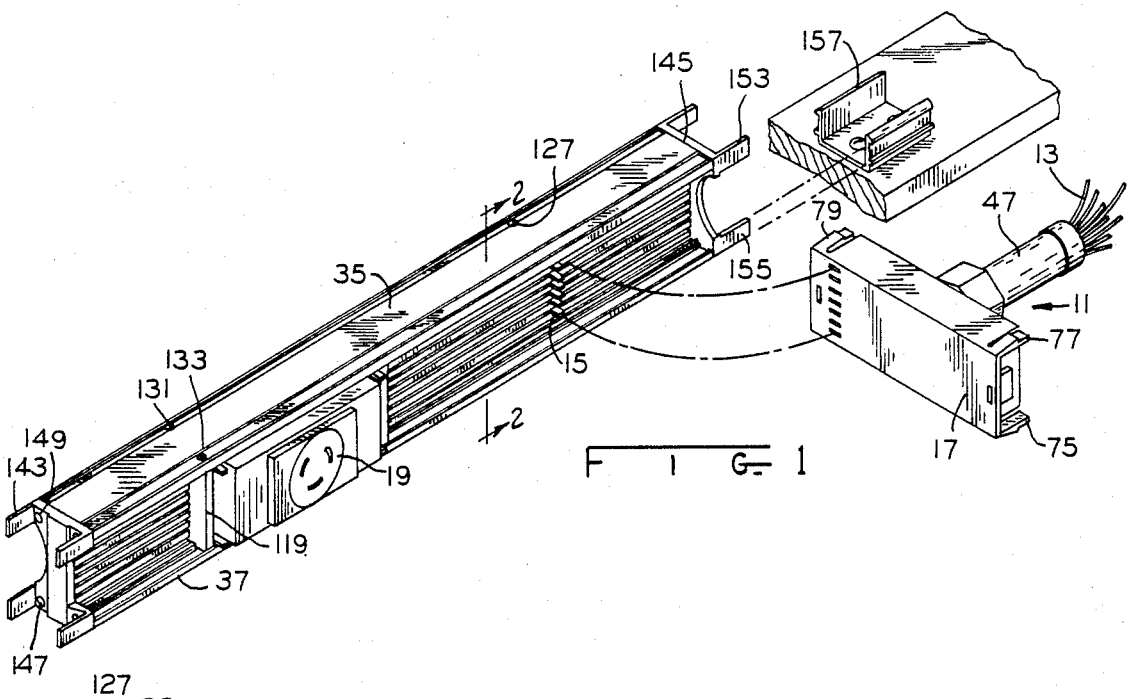
FIG. 1 is a perspective view of an elongated relatively rigid power distribution channel aligned respectively with a mechanical support bracket and a power source connector block.
Figure 9:
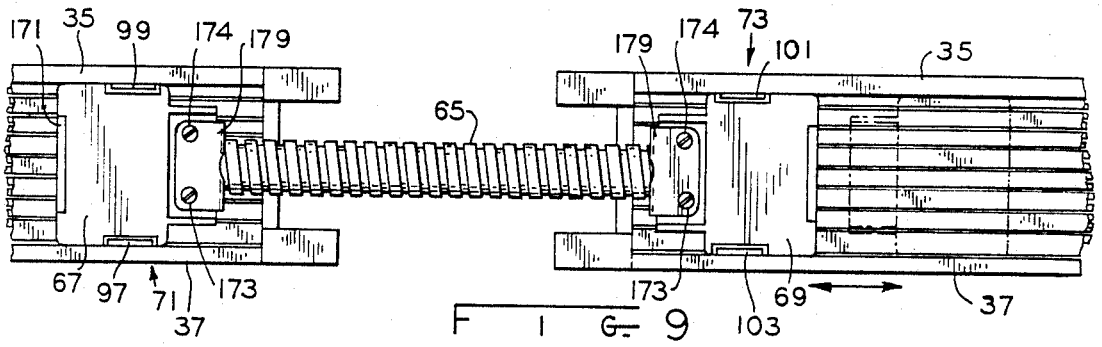
FIG. 9 is a partial side elevation view illustrating the interconnection of two power distribution channels by a flexible multiconductor cable.
Figure 10:
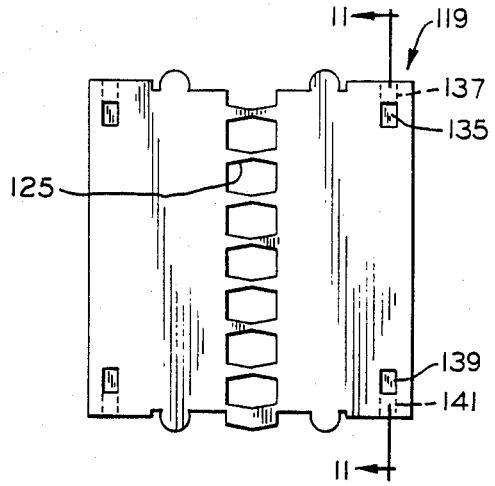
FIG. 10 is an end elevation view of a transverse multi-apertured separator for the power distribution channel.
Figure 11:
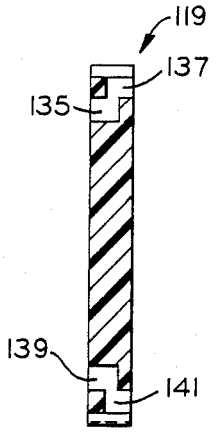
FIG. 11 is a view in cross section along lines 11—11 of FIG. 10.

Referring to the drawing generally, an electrical energy distribution system for supplying multiple circuits for a variety of end uses is illustrated and includes a rigid track or power distribution channel best seen in FIGS. 1 and 9 with this channel being manufactured in various lengths from a few inches to several feet. Flexible cables with connector fittings or blocks at their respective ends as best seen in FIGS. 3, 4 and 9 mate with the distribution channel or track to carry power to other track sections or to specific equipment.

Figure 3:
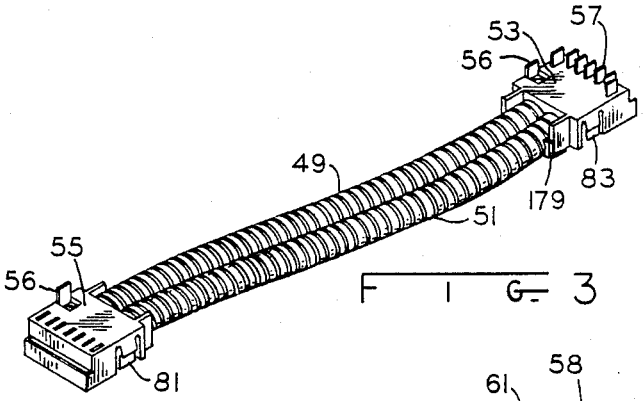
FIG. 3 is a perspective view of a flexible multiconductor cable having connector blocks at the opposite ends for coupling a pair of power distribution channels and illustrating at least two separately shielded circuits.
Figure 4:
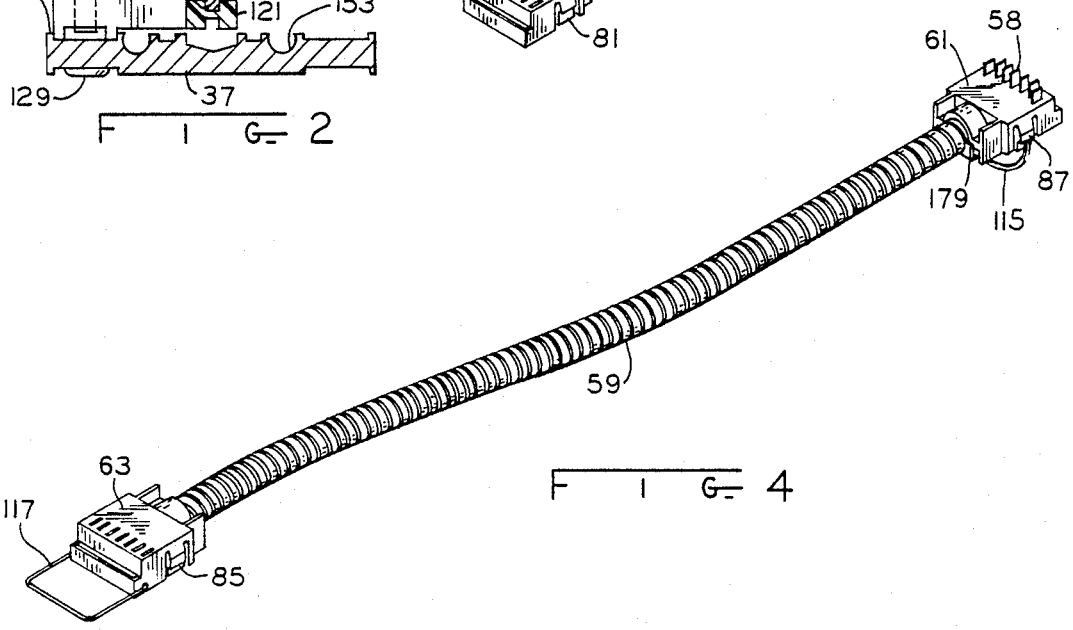
FIG. 4 is a perspective view of a flexible multiconductor cable similar to that of FIG. 3 but with all the wires of the cable shielded within a single standard flexible conduit.

The electrical energy distributionn system is disclosed as a seven conductor system providing three conventional independently fused 120 volt circuits, one of which is totally isolated from the other two and may in some cases reside within a separate flexible shield or conduit as illustrated in FIG. 3. One of the flexible conduits may contain a neutral wire, a ground wire, and two hot wires with the voltage between either of the hot wires and the ground being 120 volts while the voltage between the two hot lines is 208 volts. The other conduit then contains wholly independent hot, neutral and ground wires for a separate 120 volt source as is frequently desired for sophisticated electronic equipment.

The track or power distribution channel is fabricated in various lengths to correlate with the size of a particular item of furniture or wall to be powered and since the connecting blocks of the jumper cables may plug into a track along a range of locations as indicated by the arrow in FIG. 9, these jumper cables function to compensate for variations in the separation between two adjacent tracks while still lying flat within the system rather than sagging or bulging as in prior art schemes where plug locations are predetermined.

The flexible cable 11 of FIG. 1 brings initial power to the distribution system with the leads such as 13 being wired to a power source by a qualified electrician using traditional wiring methods. Thereafter, all connections are a simple snap fit operation requiring no tools for assembly or disassembly. Since each track or distribution channel has but a single set of cantilevered extending blades such as 15 of FIG. 1, power can be supplied to the system only from one source such as the power connector block 17.

A wide variety of receptacle options are available to provide the precise power needs for a particular installation. These various receptacles as illustrated, for example, by the twist lock outlet 19 in FIG. 1, night light 21 of FIG. 7, surge protected outlet 23 of FIG. 8, and conventional two-plug receptacle 25 of FIG. 13 all latch solidly into the track or channel at a user selected location with their blades contacting the appropriate conductor bars within the channel. At the users option, the outlets may be easily removed by depressing the four snap latches to release the outlet for repositioning at a new preferred location.

Figure 2:
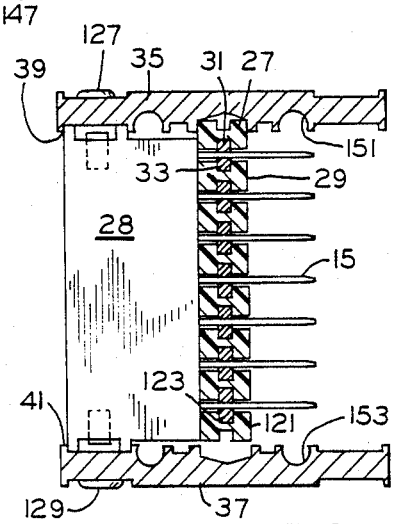
FIG. 2 is a view in cross-section along lines 2—2 of FIG. 1.

As noted earlier, improper wiring of the system is avoided by allowing but a single set of power supply or connector blades 15 in each power distribution channel. Referring specifically to FIGS. 1 and 2, the blades 15 extend toward the right as viewed in FIG. 2 in a cantilevered manner after passing between generally elongated parallel insulating strips such as 27 and 29. The blades 15 are commonly supported in an electrically isolated manner in a block 28 of insulating material. Each of the power supply blades passes through a circuit path gap between adjacent insulating strips such as 27 and 29 and each of those circuit path gaps has pair of elongated parallel conductor bars such as 31 and 33 associated therewith one to each side of the circuit path gap and juxtaposed with their respective insulating strips. Thus, the insulating strip 27 and 29 maintain the corresponding conductor bars 31 and 33 in position in the circuit path gap and in contact with the corresponding blade 15 passing therebetween. The insulating blade support member 28 is captured between top rail 35 and bottom rail 37 of the power distribution channel with overhanging lips 39 and 41 both precluding the removal of the insulating member 28 and precluding the addition of a second similar member once the power distribution channel is assembled. The power outlet blades such as 43 of FIG. 13 and 45 of FIG. 8 similarly pass into appropriate circuit path gaps contacting the conductor bars to either side thereof but in a temporary or removeable manner rather than a captive manner as member 28 supporting the power supply blades and as will be apparent as the discussion proceeds these power outlets may be received in either side of the power distribution channel and be positioned throughout several different continuous ranges or regions.

While FIG. 1 illustrated a multiconductor power supply cable 47 having a single connector block 17 at one end thereof, FIGS. 3, 4 and 9 illustrate multiconductor cables with connector blocks at each of their opposite ends for electrically joining the conductor bars of one track of the energy distribution system to a distinct like set of conductor bars in another track of the energy distribution system. Thus, in FIG. 3 a pair of flexible conduits for isolating independently fused circuits with, for example, three conductors (four if independent ground tabs 56 are employed) in conduit 49 and four conductors in conduit 51 are connected at their opposite ends to a male connector block 53 and a female connector block 55. Thus, the protruding blades such as 57 of connector block 53 may be connected to the conductor bars of a distribution channel at any point within a continuous region to receive power from that distribution channel while connector block 55 connects to the fixed protruding blades such as 15 of another power distribution channel to provide the sole source of input power to that second power distribution channel.

An optional eight wire system having four independently fused circuits has ground tabs 56 in a make-first, break-first configuration with those male tabs connecting with lower channels 37 through the gap between insulator 121 and channel 37.

FIG. 4 illustrates a similar arrangement employing but a single flexible multiconductor power supply cable 59 having at its opposite ends male connector block 61 and female connector block 63 for interconnecting a pair of tracks of the energy distribution system. Such interconnection is illustrated in FIG. 9 with the flexible multiconductor power supply cable 65 and connector blocks 67 and 69 at its respective opposite ends interconnecting the power distribution channels 71 and 73.

Each of the connector blocks and each of the outlets includes a mechanical latching arrangement for retaining the block or outlet in a conductor bar engaging position in the form of one or two opposed pairs of resilient tabs. Such tabs are illustrated at 75, 77 and 79 in FIG. 1, 81 and 83 in FIG. 3, 85 and 87 in FIG. 4, 89, 91, 93 and 95 in FIG. 7, and 97, 99, 101 and 103 in FIG. 9 to name but a few.

Figure 5:
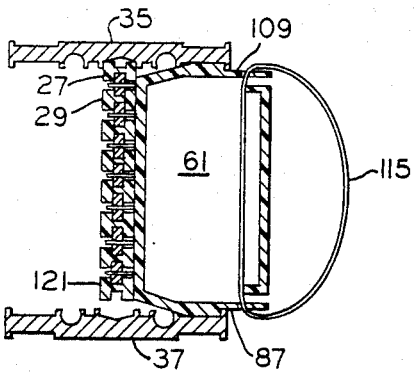
FIG. 5 is a cross-sectional view similar to FIG. 2 but illustrating the male connector block of FIG. 4 engaged with the power distribution channel.
Figure 6:
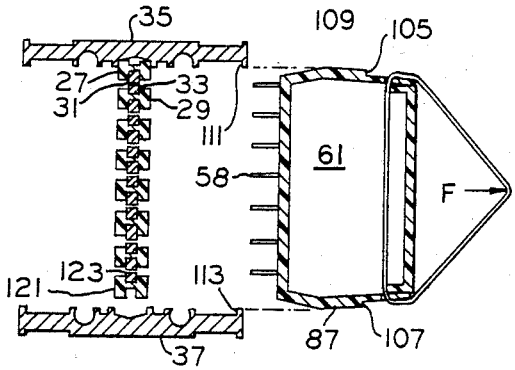
FIG. 6 is a view similar to FIG. 5 but illustrating the connector block being removed from the power distribution channel.

In particular, male connector block 61 of FIG. 4 is held in position with the blades contacting adjacent pairs of the conductor bars of a track as illustrated in FIGS. 5 and 6 with the ledges 105 and 107 of resilient tabs 109 and 87 respectively engaging overhanging lips 111 and 113 of the spaced apart top and bottom rails 35 and 37 respectively. Resilient tabs 87 and 109 may be forced toward one another by a simple pinching action disengaging the ledges 105 and 107 from their corresponding lips 111 and 113 allowing extraction of the connector block 61 by a separate pulling motion or these two operations may be combined by providing a flexible strap 115 which passes through the two resilient tabs 87 and 109 and which when pulled in the direction of the force arrow F in FIG. 6 functions not only to deform the tabs toward one another to release the block, but also urges the block away from its conductor bar engaging position. Thus, by passing through the tab free ends, the flexible strap when pulled functions to both collapse the tabs toward one another and to urge the block away from the channel.

As an alternate aid to extricating a connector block from a channel, a bale or handle 117 pivotably attached to the connector block 63 of FIG. 4 may be employed. This bale 117 facilitates pulling the connector block away from the channel, but requires a separate pinching motion on the latching mechanism such as tab 85 to release the block 63 from the channel.

Referring now to the construction of the power distribution channel in greater detail and in particularly in conjunction with FIGS. 1, 2, 6 and 10, each power distribution channel has a pair of elongated parallel spaced apart rails 35 and 37 of uniform cross-sectional configuration and captures therebetween a plurality of elongated generally parallel strips of insulating material such as 27 and 29. Adjacent pairs of these strips 27 and 29 define therebetween a circuit path gap for receiving the relatively fixed blades 15 by way of which power is supplied to the channel as well as the male or protruding blades such as 43 or 45 of a power outlet, or 57 or 58 of a flexible cable connecting power from one power distribution channel to another. Within each such circuit path gap, there is a pair of elongated parallel conductor bars such as 31 and 33 one to each side of the gap and lying partially within corresponding slots in the parallel insulating strips. Thus, the several conductor bars and insulating strips are in general vertical alignment as depicted in FIGS. 2 and 6 and share a common vertical plane extending in the direction of elongation of the channel. This alignment of insulating strips and conductor bars is maintained throughout the channel by periodic transverse insulating spacers such as 119 which engage the rails 35 and 37 as well as the strips such as 27 and 29 and the conductor bars such as 31 and 33. The several insulators such as 27 may be identical and are generally of uniform cross-sectional configuration throughout their direction of elongation, however, it will be noted that the outer most insulators 27 and 121 have only one conductor bar 31 and 123 associated therewith while the remaining insulators have a pair of generally diametrically opposed conductor bars associated therewith. The conductor bars as illustrated are of a rectangular cross-sectional configuration, however, many other configurations may be employed.

In fabricating the power distribution channel, one or two conductor bars as appropriate are nested in the elongated slots of corresponding insulators such as 29 and the insulator and its juxtaposed conductor bars passed through apertures such as 125 in the spacer 119. An insulator and its conductors may pass through one or more spacers depending upon the overall length of the insulator. Once the spacers are positioned with all insulators and conductor bars passsing therethrough, one set of commonly supported connector blades 15 are passed transversely through the gaps contacting the same conductor bars and extending in a cantilevered manner laterally therefrom for subsequent connection to a source of electrical energy. The commonly supported conductor blades on member 28 and the separators such as 119 are then captured between the elongated rails 35 and 37, for example, by passing rivits such as 127 and 129 through the respective rails and into the member 29 as well as similar rivits such as 131 and 133 into each of the spacers 119. Overlapping lateral holes such as 135 and 137 as well as 139 and 141 in the spacer 119 and similar holes in the member 28 may be provided to receive the rivits. Fabrication of the channel is then completed by capping the opposed channel ends with insulating caps 143 and 145. These caps are held in place by screws such as 147 and 149 which pass through the cap and threadingly engage semicircular cut-out portions such as 151 and 153 in the top and bottom rails. The caps also include longitudinally extending bars such as 153 and 155 which slidingly or flexibly engage corresponding tracks in a channel such as 157 to mount the distribution channel to a particular wall or piece of furniture. As thus assembled, it will be noted that the circuit path gaps are asymmetrically sandwiched between rails 35 and 37 thus precluding improper connection with a connector block or outlet.

FIG. 1 illustrates a single electrical outlet 19 affixed to the distribution channel protruding laterally from that channel a preferred distance as determined by the thickness of a central layer employed in the fabrication of the outlet. While only one outlet is illustrated in FIG. 1, there are several regions of the channel which may receive outlet to one or both sides of the channel and dependent upon channel length. The shortest channel contemplated by the present invention, for example, channel 71 of FIG. 9 would have but a single set of protruding blades for receiving the connector block 161 supplying power thereto and of a length sufficient to receive only one set of protruding blades such as 58 of FIG. 4 for interconnecting one flexible multiconductor cable 65 to another such as 59. Such a short channel is particularly useful in corners where several walls join or for simply turning a corner between two walls. The structural details of a connector block such as 161 of FIG. 9 will be best understood when that FIG. is considered in conjunction with FIG. 12.

Figure 12:
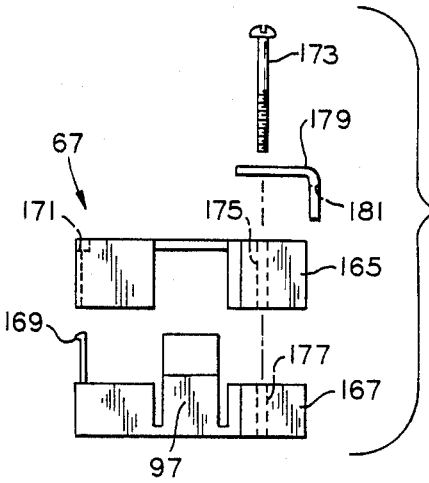
FIG. 12 is an expanded plan view of a connector block of the type illustrated in FIGS. 3, 4, 5, 6 and 9.

In FIG. 12, connector block 67 is formed from a pair of interlocking insulating shell portions 165 and 167 with portion 167 having a locking lip 169 and portion 165 having a locking lip receiving slot 171 along one edge. To assemble the two shell portions, lip 169 is inserted into slot 171 and then a rivet, screw or similar threaded fastener such as 173 which passes through hole 175 and for example threadedly engages shell portion 167 along the threaded hole 177 functions in conjunction with the inner engagement of the lip and slot to hold the two shell portions together. In practice, a somewhat conventional strain relief member 179 having an arcuate opening 181 which engages cable 65 is held in place by a pair of such screws 173 and 175 so that both the strain relief function and assembly of the two shell halves is facilitated by the screws 173 and 174.

Figure 7:
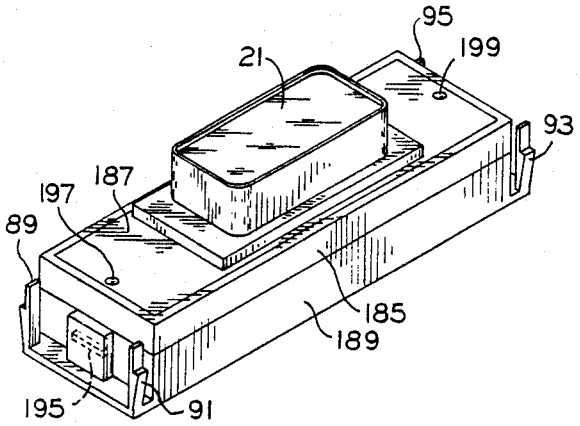
FIG. 7 is a perspective view of one of the numerous outlet box options illustrating construction features common to all.
Figure 13:
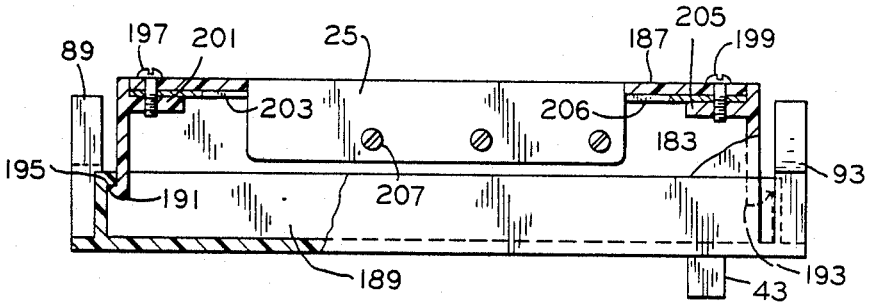
FIG. 13 is a cross-sectional view of yet another outlet box or receptacle of the type generally illustrated in FIGS. 1, 7 and 8.

As noted earlier, the electrical outlet 19 of FIG. 1 extends or protrudes laterally from the channel a preferred distance tailored to a particular furniture or wall installation with that distance being determined during the assembly of the electrical outlet by the thickness of a central layer 183 of FIG. 13 or 185 of FIG. 7. While the outlets depicted in these two FIGS. are of differing types, the common reference numerals will hereafter be employed in describing their common assembly technique. Typical assembly includes fastening together three insulative layers 187, 183 and 189. The layers 189 and 183 are joined by a pair of flexible tabs 191 and 193 engaging corresponding notches such as 195 in the lower layer 189. The upper layer 187 is then joined to the central layer 183 by a pair of screws, pop rivets or similar fasteners 197 and 199 which pass through the top layer and into a pair of lateral tabs 201 and 205 in the central layer. Fasteners 197 and 199 may additionally function to fasten a conventional two-plug outlet 25 by its conventional mounting tabs 203 and 206. Internal wiring between the conductive blades 43 and the conventional outlet connection screws such as 207 is not illustrated in FIG. 13, but will be readily understood from the discussion of the wiring within the electrical outlet of FIG. 8.

Figure 8:
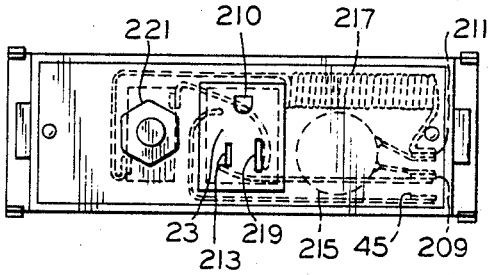
FIG. 8 is a side elevation view of another outlet box or receptacle illustrating some of the possible variations.

In FIG. 8, three conductive blades 45, 209 and 211 extend from the outlet for connection within corresponding circuit path gaps of a track. Blade 45 is connected to the neutral terminal associated with receptacle aperture 210 while blade 209 is connected to the grounded prong associated with aperture 213 of the receptacle. A capacitor 215 is connected between ground and the hot terminal associated with blade 211 and that hot terminal 211 is connected by way of an inductance or coil 217 to the hot terminal aperture 219 of the receptacle. This last connection may be made by way of a circuit breaker 221 if desired. Thus the wiring within the outlet of FIG. 8 includes not only a circuit breaker, but also a low pass filter arrangement including the capacitor 215 and inductance 217 so as to provide a measure of surge protection and to suppress transient current transmission to the receptacle 23 and any sophisticated electronic device that might be plugged into that receptacle.

From the foregoing, it is now apparent that a novel electrical energy distribution system having a plurality of power distribution channels and a plurality of flexible multiconductor cables interconnecting such channels as well as a novel method of fabricating such power distribution channels and related components have been disclosed meeting the objects and advantageous features set out hereinbefore as well as others and that modifications as to the precise configuration, shapes and details may be made by those having ordinary skill in the art without departing from the spirit of the invention or the scope thereof as set out by the claims which follow.

What is claimed is:

1. The method of fabricating an elongated relatively rigid power distribution channel comprising the steps of:

providing a number of elongated insulators of generally uniform cross-sectional configuration;

disposing elongated conductor bars along lateral surfaces of the insulators, two insulators having only one conductor bar associated therewith and the remaining insulators having a pair of generally diametrically opposed conductor bars associated therewith;

passing the insulators and their corresponding conductors through at least two spaced apart transverse multi-apertured separators to align and maintain the insulators and conductors in parallel generally coplanar alignment and with conductor bars associated with adjacent pairs of insulators facing toward and spaced from one another defining therebetween connector blade receiving gaps;

passing exactly one set of commonly supported connector blades transversely through the gaps contacting facing conductor bars and extending in cantilevered manor for subsequent connection to a source of electrical energy; and capturing the commonly supported connector blades and separators between a pair of elongated rails of generally uniform cross-sectional configuration.

2. The method of claim 1 wherein the step of capturing includes providing the multi-apertured separators with overlapping pairs of lateral slots creating rivit receiving openings, and passing rivits through the elongated rails and into the rivit receiving openings.

3. The method of claim 1 wherein the step of capturing includes insulatively capping opposed channel ends with a pair of plastic caps each having openings for receiving threaded fasteners passing therethrough in the direction of channel elongation and threadedly engaging the elongated rails.

4. The method of claim 3 wherein the threaded fasteners engage the rails along extruded openings of generally "C" shaped cross-sectional configuration.

5. The method of claim 1 including the further steps of assembling and affixing an electrical outlet to the distribution channel, the outlet protruding laterally from the channel a distance determined during the assembly step.

6. The method of claim 5 wherein the step of assembling includes fastening three insulative layers together with the thickness of the central of the three layers selected to determine the lateral protrusion distance.

7. The method of claim 5 wherein the step of assembling includes electrically interconnecting a set of outwardly extending conductive blades and an electrical receptacle.

8. The method of claim 7 wherein the step of electrically interconnection includes prewiring the outlet to suppress transient current transmission to the receptacle.

9. The method of claim 8 wherein the step of prewiring includes connecting an inductance in series between a conductive blade and the electrical receptacle, and connecting a capacitor between a pair of conductive blades.

10. The method of claim 1 including the further step of electrically grounding at least one of the elongated rails with a connector block having a protruding make-first, break-first ground tab.

* * * * *